US011486237B2

(12) United States Patent
Ellithorp

(10) Patent No.: US 11,486,237 B2
(45) Date of Patent: Nov. 1, 2022

(54) APPARATUS TO LOCATE AND ISOLATE A PUMP INTAKE IN AN OIL AND GAS WELL UTILIZING A CASING GAS SEPARATOR

(71) Applicant: Blackjack Production Tools, LLC, Oklahoma City, OK (US)

(72) Inventor: Brian Ellithorp, Edmond, OK (US)

(73) Assignee: Blackjack Production Tools, LLC, Oklahoma City, OK (US)

( * ) Notice: Subject to any disclaimer, the term of this patent is extended or adjusted under 35 U.S.C. 154(b) by 24 days.

(21) Appl. No.: 17/128,935

(22) Filed: Dec. 21, 2020

(65) Prior Publication Data

US 2021/0189851 A1 Jun. 24, 2021

Related U.S. Application Data

(60) Provisional application No. 62/951,781, filed on Dec. 20, 2019.

(51) Int. Cl.
*E21B 43/12* (2006.01)
*E21B 43/10* (2006.01)
*E21B 43/38* (2006.01)

(52) U.S. Cl.
CPC ..... *E21B 43/128* (2013.01); *E21B 43/105* (2013.01); *E21B 43/38* (2013.01)

(58) Field of Classification Search
CPC ..... E21B 33/124; E21B 33/126; E21B 43/13; E21B 43/128; E21B 43/38
See application file for complete search history.

(56) References Cited

U.S. PATENT DOCUMENTS 1,578,720 A 3/1926 Derby
1,665,540 A 4/1928 Green
2,562,079 A * 7/1951 Baker ..... E21B 33/124 277/323
2,883,940 A 4/1959 Gibson
3,357,492 A 12/1967 Hubby
3,593,797 A * 7/1971 Lebourg ..... E21B 33/124 166/290
3,894,583 A 7/1975 Morgan
4,241,788 A 12/1980 Brennan
(Continued)

OTHER PUBLICATIONS

International Searching Authority, "PCT Written Opinion of the International Searching Authority", dated Dec. 14, 2018, 9 pages, Korean Intellectual Property Office.
(Continued)

*Primary Examiner* — David Carroll
(74) *Attorney, Agent, or Firm* — Tomlinson McKinstry, P.C.

(57) ABSTRACT

An isolation device for use with a casing gas separator. The device incorporates multiple cups, some upward-facing and others downward-facing. The downward-facing cup or cups seal against an internal surface of the casing gas separator to divert flow into the annulus of the separator and enable the separation process. The upward-facing cup or cups hold a pressurized fluid when the device is being located within the casing. Upon reaching the upper ports of the casing gas separator, the fluid releases into the annulus, allowing an operator to determine the location of the device and accurately place it within the casing gas separator.

13 Claims, 6 Drawing Sheets

(56) References Cited

U.S. PATENT DOCUMENTS

| | | | | |
|---|---|---|---|---|
| 4,319,638 | A * | 3/1982 | Baker | E21B 33/146 166/186 |
| 4,676,308 | A | 6/1987 | Chow et al. | |
| 4,981,175 | A | 1/1991 | Powers | |
| 5,653,286 | A | 8/1997 | McCoy et al. | |
| 6,039,121 | A | 3/2000 | Kisman | |
| 6,155,345 | A | 12/2000 | Lee et al. | |
| 6,325,143 | B1 | 12/2001 | Scarsdale | |
| 6,932,160 | B2 | 8/2005 | Murray et al. | |
| 7,021,373 | B2 | 4/2006 | Hardgrave | |
| 7,055,595 | B2 | 6/2006 | Mack et al. | |
| 7,270,178 | B2 | 9/2007 | Selph | |
| 7,635,030 | B2 | 12/2009 | Knight et al. | |
| 7,736,133 | B2 | 6/2010 | Martinez | |
| 8,141,625 | B2 | 3/2012 | Reid | |
| 8,397,811 | B2 | 3/2013 | Reid | |
| 9,518,458 | B2 | 12/2016 | Ellithorp et al. | |
| 9,909,400 | B2 | 3/2018 | Ellithorp et al. | |
| 10,385,672 | B2 | 8/2019 | Zahran | |
| 2004/0112588 | A1* | 6/2004 | Mullins | E21B 21/103 166/177.3 |
| 2005/0081718 | A1 | 4/2005 | Carruth | |
| 2007/0119588 | A1 | 5/2007 | Gonzalez | |
| 2009/0065202 | A1 | 3/2009 | Brown et al. | |
| 2010/0319926 | A1 | 12/2010 | Reid | |
| 2011/0162832 | A1* | 7/2011 | Reid | E21B 43/128 166/244.1 |
| 2011/0162833 | A1* | 7/2011 | Cobb | B01D 21/267 166/105.5 |
| 2013/0032341 | A1 | 2/2013 | Raglin | |
| 2013/0068455 | A1 | 3/2013 | Brown et al. | |
| 2014/0110133 | A1* | 4/2014 | Ellithorp | E21B 43/127 166/105.5 |
| 2017/0044888 | A1 | 2/2017 | Bommer | |
| 2017/0058654 | A1 | 3/2017 | Ellithorp et al. | |
| 2017/0081952 | A1 | 3/2017 | Osborne et al. | |
| 2018/0023379 | A1 | 1/2018 | Marshall | |
| 2018/0187531 | A1 | 7/2018 | Ellithorp et al. | |
| 2018/0280834 | A1 | 10/2018 | Marshall | |
| 2019/0055809 | A1 | 2/2019 | Ellithorp | |

OTHER PUBLICATIONS

International Searching Authority, "PCT International Search Report", dated Dec. 14, 2018, 3 pages, Korean Intellectual Property Office.

International Bureau of WIPO, "PCT International Preliminary Report on Patentability", dated Feb. 18, 2020, 10 pages, Geneva, Switzerland.

International Searching Authority, "PCT Written Opinion of the International Searching Authority", dated Jun. 24, 2020, 8 pages, Korean Intellectual Property Office.

International Searching Authority, "PCT International Search Report", dated Jun. 24, 2020, 3 pages, Korean Intellectual Property Office.

International Searching Authority, "PCT Written Opinion of the International Searching Authority", dated Apr. 6, 2021, 6 pages, Korean Intellectual Property Office.

International Searching Authority, "PCT International Search Report", dated Apr. 6, 2021, 3 pages, Korean Intellectual Property Office.

* cited by examiner

APPARATUS TO LOCATE AND ISOLATE A PUMP INTAKE IN AN OIL AND GAS WELL UTILIZING A CASING GAS SEPARATOR

SUMMARY

The present invention is directed to an assembly. The assembly comprises a production tubing string. The tubing string comprises a tube, a pump coupled to the tube, and an isolation device. The isolation device comprises a tubular portion, a first cup disposed about the tubular portion, and a second cup disposed about the tubular portion. The first cup and second cup each have an open end defining an annular space within the open end, the annular space surrounding the tubular portion. The first and second cups are spaced apart and disposed with their open ends in face-to-face orientation. A pump inlet is disposed between the tube and the isolation device.

In another aspect, the invention is directed to a kit. The kit comprises a tubular string, a fluid isolator, and a casing gas separator. The tubular string has at least one pump and a fluid inlet. The fluid isolator is disposed on the tubular string and has a plurality of expandable seals disposed thereon. A first of the expandable seals is expandable in response to flow in a first direction and a second of the expandable seals is expandable in response to flow in a second direction. The casing gas separator comprises a hollow first section and an annular second section disposed about the hollow first section. First ports and second ports are formed between the first and second sections, and spaced apart. The fluid isolator is receivable within the hollow first section of the casing gas separator.

In another aspect, the invention is directed to an isolator for use in an oil and gas well. The isolator comprises a central tubular element, a first cup and a second cup. The first cup is disposed about the tubular element and defines an open and a closed end. The second cup is disposed about the tubular element and defines an open and a closed end. The first and second cup are configured to expand in response to a higher pressure at the open end than at the closed end.

BRIEF DESCRIPTION OF THE DRAWINGS

FIGS. 3-6 are not to scale such that the lower ports and upper ports of the casing gas separator depicted, and detail of the isolation tool may be shown in the same figure. However, it should be understood that the gap between the top ports and bottom ports of the casing gas separator may be greater than shown in FIGS. 3-6.

DETAILED DESCRIPTION

This invention is directed to a device which will allow flow isolation and tool locating in an oil and gas well. In particular, the device is coupled with a form of artificial lift (commonly an Electrical Submersible Pump ("ESP") or rod pump ("RP")). The wells in which such a device may be useful may have a horizontal lateral and/or heavily deviated bottom section. The well may produce its fluids through what is known as a casing gas separator ("CGS"). One such separator is taught in U.S. Pat. No. 9,518,458, issued to Ellithorp, et al., the contents of which are incorporated herein by reference. The tool of the present invention is shown within a casing gas separator 80 assembly in FIGS. 3-6 herein.

Figure 6:
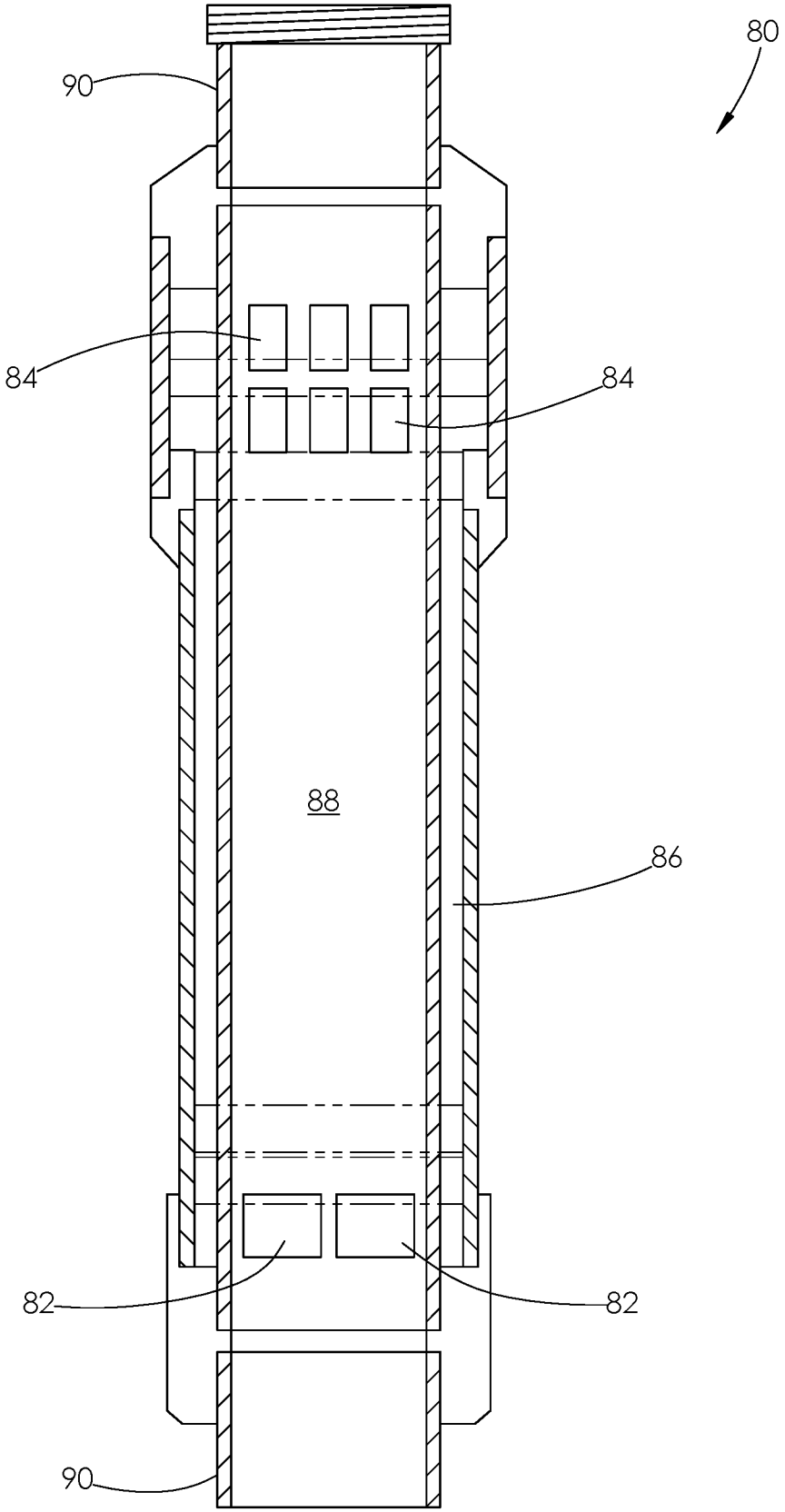
FIG. 6 is a partially sectional side view as in FIG. 3, with only the casing gas separator shown.

As best shown in FIG. 6, a casing gas separator 80 is shown for use in an oil and gas well. The casing gas separator 80 is disposed on a casing string 90. Such casing gas separators 80 are most often located and set permanently in one of two locations. The first location is at a vertical setting position immediately at the kickoff point of the well's curve. The second location is in a tangent section nearer to the bottom of the curve, often around 45-60 degrees inclination. However, a CGS 80 can be placed anywhere between those points or even well above the kickoff point.

A casing gas separator 80 generally has a lower port 82 and upper ports 84. These ports should be isolated such that fluids are directed around the point of isolation into an annulus 86 around the separator 80 by the lower port 82, with fluid then allowed to drop to a pump 50 inlet 52 when it reenters the casing at the upper ports 84. Typically, some isolation tool is used in the main hollow section 88 of the separator 80.

With the CGS 80 in place, the pump 50 may be provided on a tubing string 60. The pump 50 is used to artificially lift the well fluids from a pump inlet 52. The pump 50 may have a motor 54 coupled thereto, along with sensors 56 for detecting pressures and temperature of fluid. Through these detected conditions, elements of well dynamics such as fluid flow may be determined. This device would need to be set at a position such that the intake to the pump 50 and ultimately the tubing string 60 would be placed below the lowermost point of the CGS's upper ports 84 and above the uppermost point of the lower intake ports 82.

There is typically a rather short length between these ports 82, 84, likely between ~30-70', depending on the CGS 80 design. To land a pump intake port 52 of a form of artificial lift perfectly between these two points may be accomplished, with some difficulty, by "strapping." "Strapping" is when direct measurement is taken of all tools, tubing, etc. to be screwed together on the surface before dropping them underground. The present invention, as depicted in the figures, was invented to both provide isolation for activating a casing gas separator 80 and easy location of the tool for that purpose.

Figure 1:
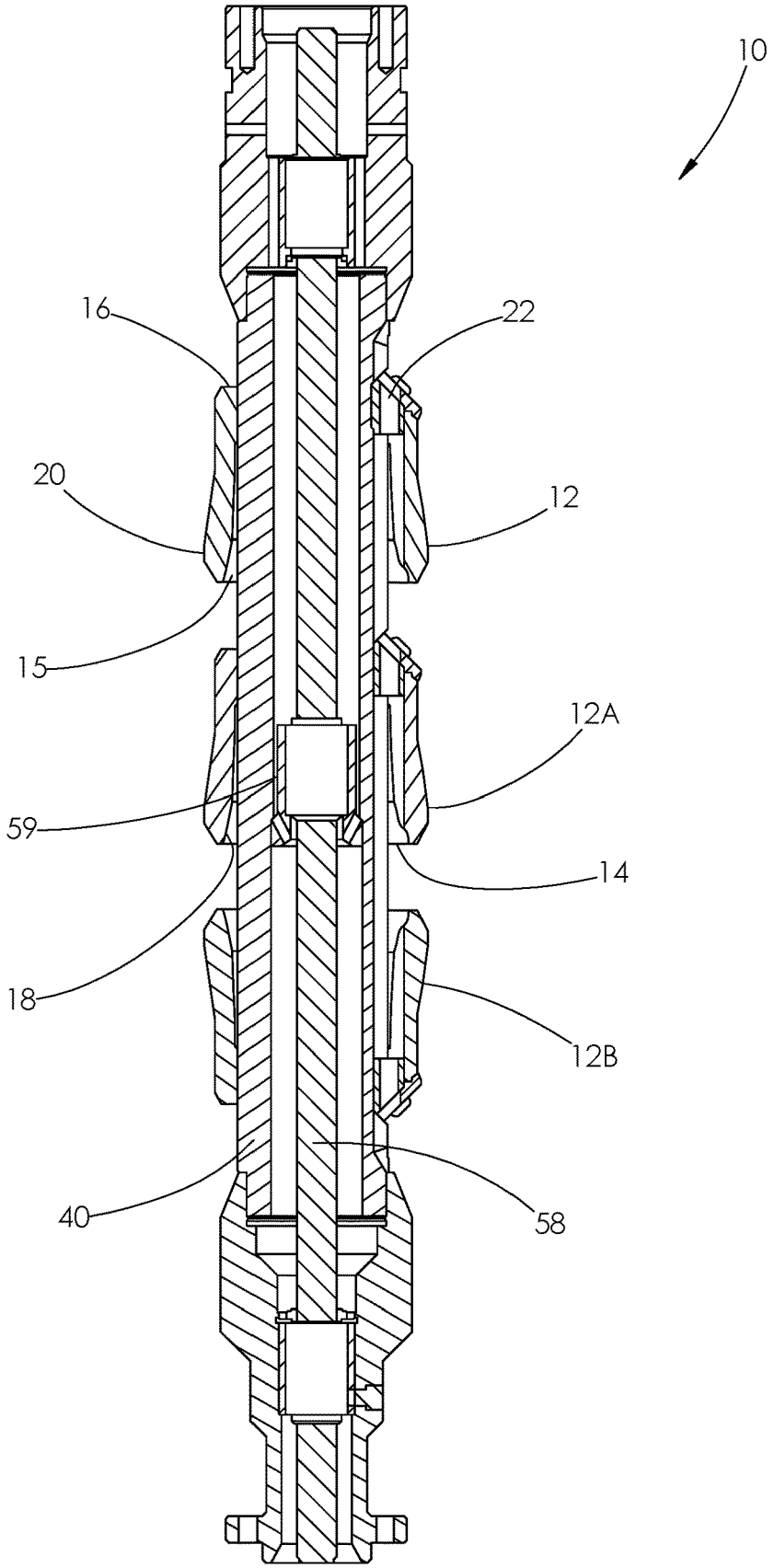
FIG. 1 is a side sectional view of an apparatus for locating and isolating a pump intake.
Figure 2:
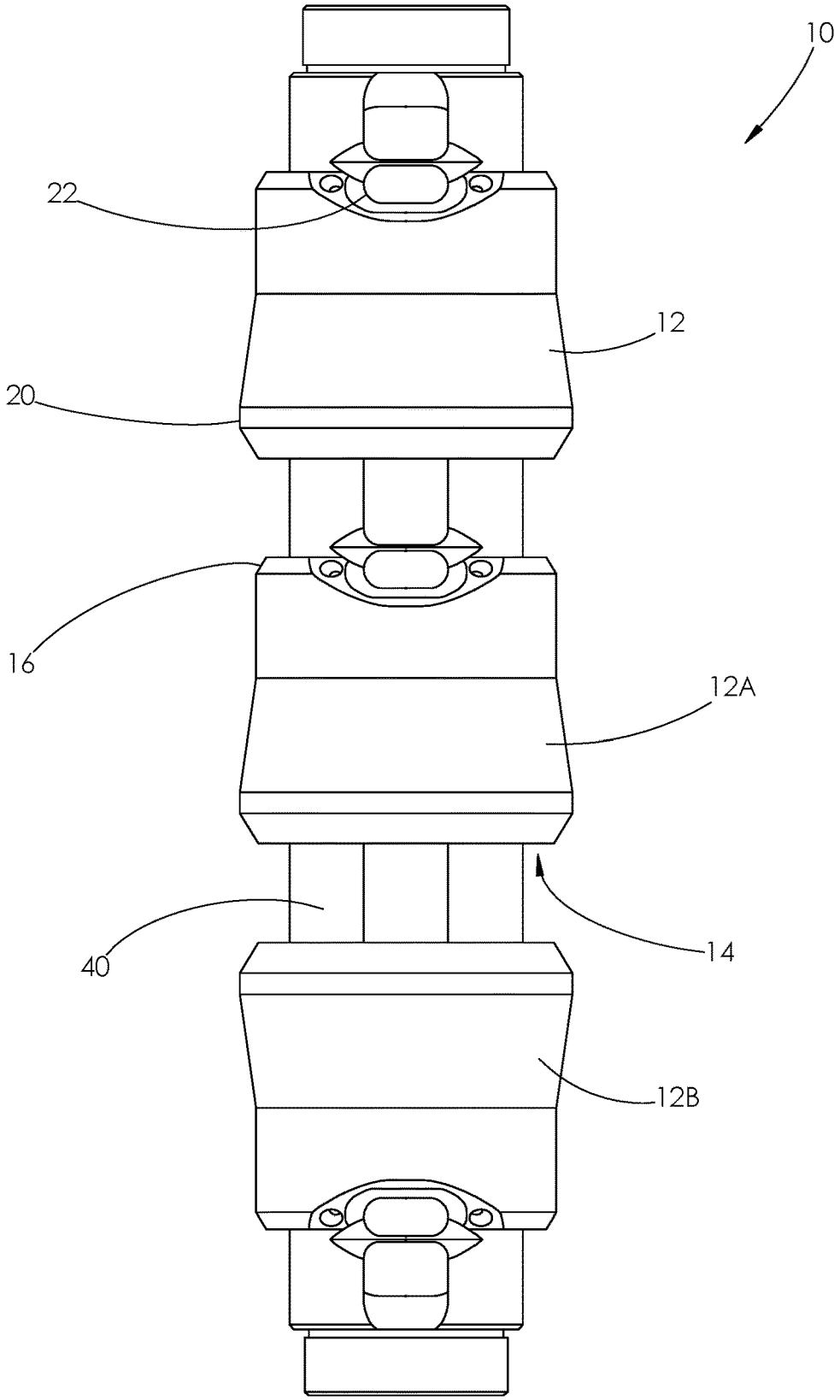
FIG. 2 is a side view thereof.

Shown in the Figures in general, and FIGS. 1-2 in particular, is a location and fluid isolation tool 10. The tool 10 is comprised of a series of sealing cups 12 and/or other expandable elements affixed to a mandrel 40 able to be connected to the lift type chosen. If connected to an electrical submersible pump, it would likely be made up into its assembly. If connected to a rod pump, the tool 10 may be placed at the bottom of a tubing string 60 immediately below a tubing intake.

The cups 12 are preferably expandable, such that when a differential pressure exists across the cup (that is, a pressure higher at the open end 14 than at the closed end 16), they expand to form a seal against the inner diameter of the casing gas separator 80. Other structures may be used to accomplish this, so long as the structure is capable of sealing against the inner diameter when a pressure is exerted from a preferred side.

Each cup 12 has an open end 14 and a closed end 16. The open ends 14 have an internally-disposed surface 18 which tapers along the length of the cup 12, forming an annular cavity 15 between the mandrel 40 and the cup. When exposed to fluid flow in a direction into the open ends 14, the tapered nature of the internally-disposed surface 18 will cause the annular cavity 15 to stretch and expand as a result of the pressure differential across the cup 12. An outer surface 20 of the cup 12 has a larger outer diameter near the open end 14 than it does near the closed end 16. Preferably, this outer diameter is a significant percentage of the inner diameter of the casing gas separator 80. One or more cable grommets 22 may be used in each cup 12 to allow a 25 motor lead extension to pass through the tool assembly 10 without interfering with the functions described herein. A motor lead extension is used to connect the motor 54 to a power source at the surface. The grommets 22 allow the cups 12 to maintain their seal without fluid leaking across the grommeted pass-through of each cup.

As a result, flow into annular cavity 15 from the open ends 14, especially high flow with a high differential pressure across the cup 12, will result in an expansion of the cup. Likewise, opposite flow (across the closed end of the cup) may cause a slight contraction of the cup 12, allowing it to pass more easily through the casing 90 and casing gas separator 80.

Figure 3:
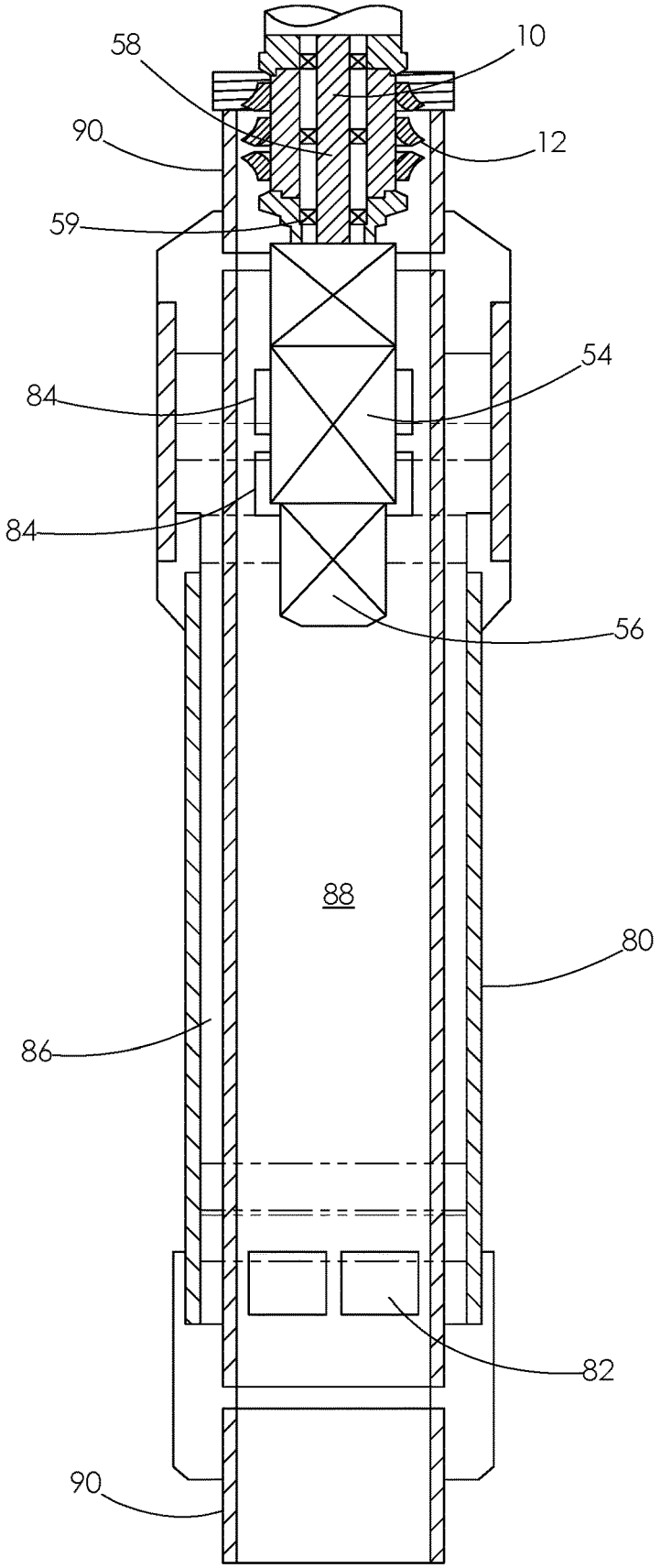
FIG. 3 is a partially sectional side view of a casing string having a casing gas separator suspended thereon, with the apparatus and other tools suspended therethrough at a first position. The first position is above the top discharge of the casing gas separator.
Figure 4:
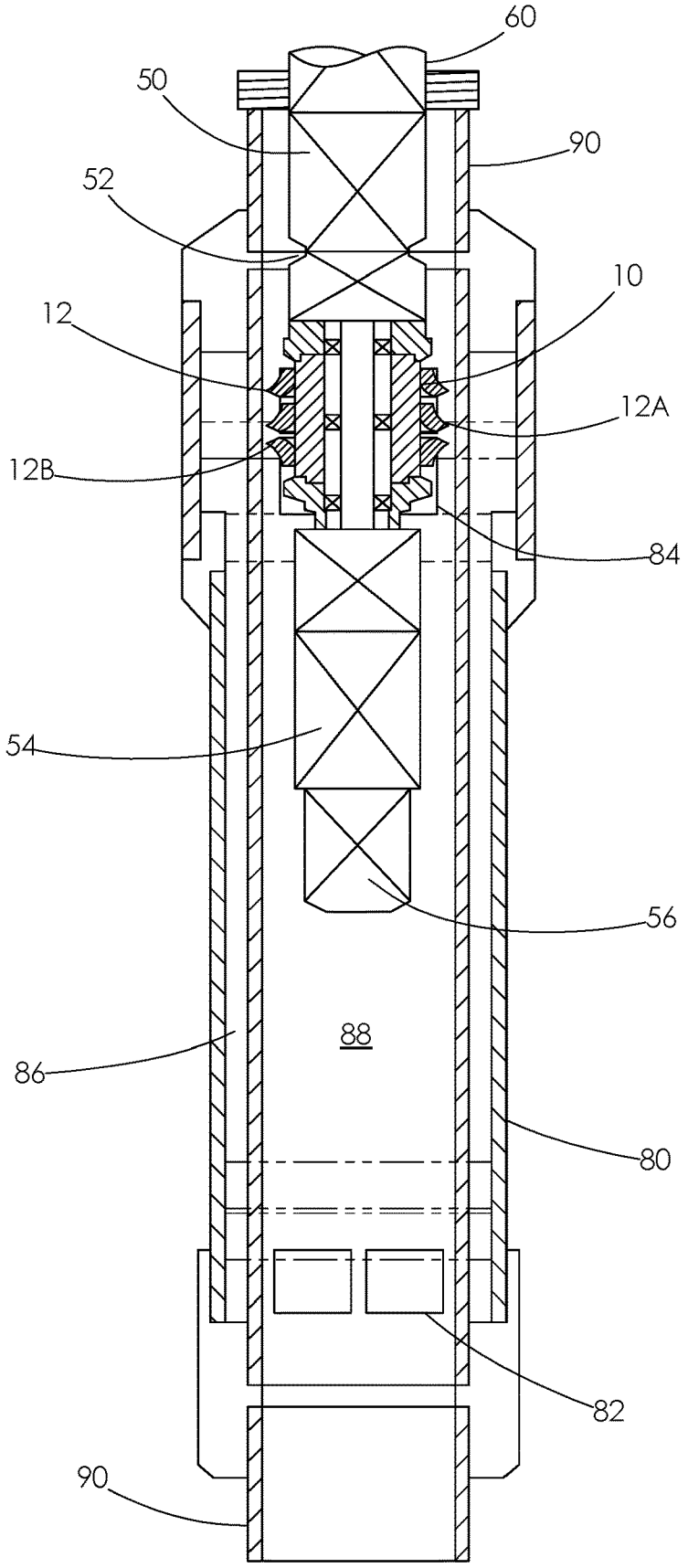
FIG. 4 is a partially sectional side view as in FIG. 3, with the apparatus disposed at the top discharge, such that the location of the apparatus relative to the casing gas separator ports can be ascertained.
Figure 5:
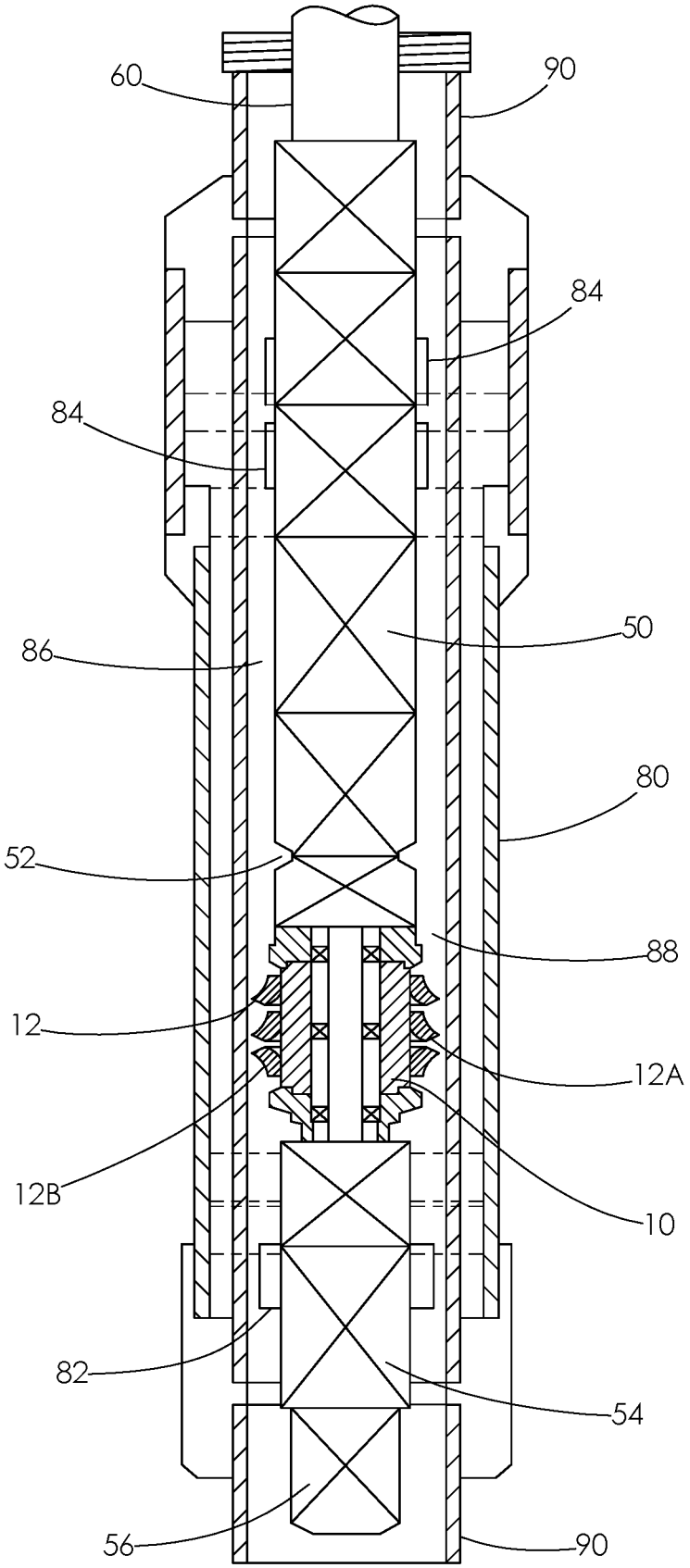
FIG. 5 is a partially sectional side view as in FIG. 3, with the apparatus in place between the intake and the discharge ports of the casing gas separator.

For use with an ESP, as shown in FIGS. 3-5, the tool 10 is designed to most commonly be made up in the pump 50 assembly below the pump intake 52. A shaft 58 runs through the center of the tool 10, centered therewithin by bearings 59. This shaft allows the transfer of power from the motor or motors 54 to the pump 50, without interfering in the operation of the tool 10.

As shown in FIG. 1, three cups are used, given numbers 12A-12B, though a different number of cups 12 may be used, in varying configurations. The top cup 12A or cups is shown oriented with their open ends 14 facing downward, relative to the tubing string and the bottom cup or cups 12B will be facing upward.

In the embodiment shown, the open ends 14 of the upward cup or cups 12B are in face-to-face orientation with the open ends 14 of the downward facing cup or cups 12A. While this orientation may be advantageous, the upward cup 12B may be disposed at the top end of the isolation tool 10, such that the upward facing cups are not in face-to-face orientation with the downward facing cups 12A.

When expanded, these cups 12 engage with the inner diameter of the casing and the inner diameter of the inner casing of the casing gas separator 80 between the upper slots 84 and lower intake ports 82, where the tool 10 will ultimately be set for operation.

Without the tool 10 in place, fluid and gas flow would normally pass upward between the ID of the casing 90 and the outside of the tubing 60. The multi-phase fluid flow would thus reach the intake 52 of the pump after it passes sensors 56 and motor or motors 54 disposed therebelow.

With the tool 10 in place, the fluid/gas mixture would be prohibited from flowing along this normal pathway since the fluid flow would expand the downward facing cups 12A on the tool 10. As the cups 12A expand, their outer surfaces 20 engage and seal against the inner wall of the casing separator 80.

After expansion, the pathway of least resistance then becomes the conduit through the annulus 86 created by the casing gas separator 80, which would allow the mixture to flow by the pump motor 54 then make a turn into the CGS annulus 86.

After flowing upward to the top of the annulus 86, the mixture then reenters the hollow section 88 of the separator 8*o* through the upper ports 84. Gas flow then continues upward between the pump 50 sections or the tubing string 6*o* and casing 90 inner wall, in a normal fashion for typical pump operation. Liquid entering through the upper port 84 falls, due to gravity, and is removed to the inside of the tubing 60 through the inlet 52 of the pump 50 for extraction to the surface.

Beyond flow isolation, the tool 10 has the ability to be accurately located due to the upward facing cup or cups 12B. The upward facing cup 12B expands when a fluid load is carried on top of the cup 12B as the tubing string 6*o* and pump 50 are inserted into the casing 80. Hydrostatic actuation will be the most common method of utilizing the locating function with this tool.

With the tool 10 made up as a part of the pump system 50 previously described at the end of a tubing string 60, the tool 10 can be lowered, or "tripped" into the well and well casing 90. When an operator's best estimate is that the tool 10 is within a short distance (for example, 50 to 100 feet) of the casing gas separator 80, fluid can be loaded into the annulus between the tubing 60 and casing 90. The fluid will fall downhole and ultimately land on top of the upward facing cup or cups 12B on the tool 10.

When the heavy fluid load above the upward cups 12B exceeds the pressure present from below, the cup(s) will expand such that their outer surface 20 engages with the casing 90 and seals. This orientation is generally shown in FIG. 3. With this seal in place the more fluid that is loaded into the annulus between the casing 90 and tubing 60 will create a higher hydrostatic load and a larger differential of pressure across the cup 12B.

In this condition, the tubing 60, pump 50 and tool 10 can be lowered into the well slowly. As the upward cup or cups 12B bearing the hydrostatic load begin to straddle the upper ports 84, which are typically longer than the height of each cup 12, the carried fluid load from above will escape into the annulus 86, overcoming the pressure from within the wellbore from below. The fluid column, previously held above the tool 10, will begin to push itself downward into the wellbore and will force the fluids that were previously located below back into the open perforations and formation, forcing the well to go on what is known as a "vacuum."

When the vacuum occurs, the operator will be able to detect the change in pressure at a wellhead casing valve at the surface. As a result, an operator will know precisely the location of the upward facing cup 12B because straddling across the upper port 84 is the only time that condition is feasible. This condition is generally shown in FIG. 4.

With the location of the tool 10 and its cups 12 now known within a couple feet of accuracy, the tool can be further lowered to be placed properly between the ports 82, 84 of the casing gas separator 80. The load can be released from above the tool 10, resulting in well pressure from below overcoming the pressure exerted from above, activating the isolation function of the tool 10 and cups 12, as shown in FIG. 5.

Without this locating function it would be very easy to miscalculate the landing depth of the sealing flow isolation cups 12 and if placed above or below the desired and absolutely required set position the pump 50 would be starved for fluid and would get hot, constantly overheat, and ultimately cause a pump equipment failure and have to be pulled and repaired. While not the only dimensions possible, the casing gas separator 80 generally has approximately 50 feet between its ports 82, 84. The tool 10 may be less than ten feet long. This "window" must be hit precisely, underground, perhaps miles away from the entry to the wellbore. The ability to precisely locate, set, and direct flow with this tool 10 is a unique set of functions that doesn't exist in any other isolation tools available.

It should be understood that, in order to fully depict the operational steps of placing the tool 10 within the casing gas separator 80, as depicted in FIGS. 3-5, the length of the casing gas separator is truncated considerably. The figures should be construed as showing the structure and function of the invention, therefore, and not as a strict guide to the dimensions of a preferred embodiment.

Changes may be made in the construction, operation and arrangement of the various parts, elements, steps and procedures described herein without departing from the spirit and scope of the invention as described in the following claims.

The invention claimed is:

1. A system, comprising:

an isolator for use in an oil and gas well, comprising:

a central tubular element;

a first cup disposed about the tubular element, the first cup defining an open end and a closed end; and a second cup disposed about the tubular element, and spaced apart from the first cup, the second cup defining an open end and a closed end;

in which the first cup and the second cup are configured to expand in response to a higher pressure at the open end than at the closed end; and a pump coupled to the central tubular element, wherein the central tubular element defines a pump inlet thereupon;

in which the isolator is configured for installation in a casing gas separator comprising:

a first hollow section;

an annular section disposed about the first hollow section; and first and second vertically displaced ports between the hollow section and the annular section;

in which the pump inlet is configured for placement within the hollow section between the isolation device and the second port in response to the expansion of the first and second cup.

2. The isolator of claim 1 further comprising:

a third cup disposed about the tubular element and spaced apart from the first cup and the second cup, the third cup defining an open end and a closed end;

in which the open end of the first cup and the open end of the second cup are disposed in a face-to-face orientation; and in which the third cup is disposed in a substantially similar orientation as the second cup.

3. The isolator of claim 1 further comprising:

a rotatable shaft, disposed within the tubular element and relatively rotatable thereto; and one or more bearings configured to support the shaft within the tubular element.

4. A system comprising:

a wellbore having an uphole end;

a hollow casing disposed within the wellbore; and the system of claim 1, in which:

the isolator is disposed within the casing gas separator with the pump inlet between the isolation device and the second port.

5. An assembly, comprising:

a production tubing string comprising:

a tube;

a pump coupled to the tube; and an isolation device, comprising:

a tubular portion;

a first cup disposed about the tubular portion, the first cup having an open end and defining an annular space within the open end and surrounding the tubular portion; and a second cup disposed about the tubular portion and spaced apart from the first cup, the second cup having an open end and defining an annular space within the open end and surrounding the tubular portion;

wherein the first cup and the second cup are disposed with their open ends in face-to-face orientation; and wherein a pump inlet is disposed on the production tubing string between the tube and the isolation device; and a casing gas separator comprising:

a first hollow section;

an annular section disposed about the first hollow section;

at least one first port, in which the first port provides fluid communication between the first hollow section and the annular section;

at least one second port, spaced apart from the at least one first port, in which the at least one second port provides fluid communication between the first hollow section and the annular section;

wherein the isolation device is disposed between the first port and the second port of the casing gas separator;

in which the pump inlet is disposed within the hollow section between the isolation device and the at least one second port.

6. The assembly of claim 5 in which the first cup and the second cup are expandable in response to a first pressure condition, in which the first pressure condition is defined as a higher pressure existing at the open end than at the closed end.

7. A system comprising:

a wellbore having an uphole end;

a hollow casing disposed within the wellbore; and the assembly of claim 5, in which:

the casing gas separator is attached to the casing; and the production tubing string is disposed within the casing.

8. A method of using the assembly of claim 5, comprising:

lowering the production tubing string into a casing of a well-bore;

while lowering the production tubing string, expanding the first cup with a fluid disposed above the first cup;

monitoring the fluid; and determining a change in the fluid indicative of the first cup reaching a fluid port of a casing gas separator connected to the casing.

9. The method of claim 8, further comprising;

after determining the change in the fluid, lowering the production tubing string a predetermined amount, such that the isolation device is disposed below the fluid port; and ceasing the step of expanding the first cup with the fluid disposed above the first cup.

10. The assembly of claim 5 in which the pump is an electrical submersible pump.

11. A system configured for installation in a wellbore defining an uphole end, the system comprising:

a production tubing string comprising:

a tube;

a pump coupled to the tube; and an isolation device, comprising:

a tubular portion;

a first cup disposed about the tubular portion, the first cup having an open end and defining an annular space within the open end and surrounding the tubular portion; and a second cup disposed about the tubular portion and spaced apart from the first cup, the second cup having an open end and defining an annular space within the open end and surrounding the tubular portion; and a third cup, spaced apart from the first cup and the second cup and defining an open end oriented in a downhole direction;

wherein:

the first cup and the second cup are disposed with their open ends in face-to-face orientation;

the first cup is oriented such that it is below the second cup; and the open end of the first cup is open in the uphole direction;

wherein a pump inlet is disposed on the production tubing string between the tube and the isolation device; and a casing gas separator comprising:

a first hollow section;

an annular section disposed about the first hollow section;

at least one first port, in which the first port provides fluid communication between the first hollow section and the annular section;

at least one second port, spaced apart from the at least one first port, in which the at least one second port provides fluid communication between the first hollow section and the annular section;

wherein the isolation device is disposed between the first port and the second port of the casing gas separator.

12. The system of claim 11 in which the third cup is disposed between the first cup and the second cup.

13. A system comprising:

a wellbore having an uphole end;

a hollow casing disposed within the wellbore; and the assembly of claim 11, in which:

the casing gas separator is attached to the casing; and the production tubing string is disposed within the casing.

* * * * *